US006942919B2

(12) United States Patent
Tokiyoshi et al.

(10) Patent No.: US 6,942,919 B2
(45) Date of Patent: Sep. 13, 2005

(54) COATED PAPER SHEET

(75) Inventors: Tomofumi Tokiyoshi, Yokohama (JP); Shota Amasaki, Kasugai (JP); Masaaki Shimizu, Tokyo (JP); Nobuyasu Sasaguri, Chiba (JP); Kenji Yanagisawa, Amagasaki (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 10/106,045

(22) Filed: Mar. 27, 2002

(65) Prior Publication Data

US 2003/0059601 A1 Mar. 27, 2003

(30) Foreign Application Priority Data

Mar. 28, 2001 (JP) ..... 2001-094208

(51) Int. Cl.[7] ..... B32B 5/16; B32B 27/10

(52) U.S. Cl. ..... 428/327; 428/331; 428/402; 428/537.5

(58) Field of Search ..... 428/323, 327, 428/331, 402, 409, 411.1, 532, 535, 537.5

(56) References Cited

U.S. PATENT DOCUMENTS

| | | | | |
|---|---|---|---|---|
| 4,265,969 A | | 5/1981 | Yasuda et al. | |
| 4,778,711 A | | 10/1988 | Hosomura et al. | |
| 5,118,533 A | | 6/1992 | Saji et al. | |
| 5,420,190 A | * | 5/1995 | Gane | 524/446 |
| 5,700,852 A | * | 12/1997 | Iwanaga et al. | 523/201 |
| 5,756,646 A | * | 5/1998 | Nasu et al. | 528/310 |
| 5,853,870 A | * | 12/1998 | Uchimura et al. | 428/329 |
| 6,149,723 A | * | 11/2000 | Pruett et al. | 106/486 |

FOREIGN PATENT DOCUMENTS

| | | |
|---|---|---|
| EP | 0 634 283 A1 | 1/1995 |
| JP | 62-117897 | 5/1987 |
| JP | 6-65896 | 3/1994 |
| JP | 7-324112 | 12/1995 |
| JP | 9-31141 | 2/1997 |
| JP | 9-188998 | 7/1997 |
| JP | 2000-226791 | 8/2000 |
| JP | 2000-226794 | 8/2000 |

OTHER PUBLICATIONS

JIS Z 8741: 1997.
JIS P 8117: 1998.
European Search Report 02 25 2194, Jun. 11, 2002.

* cited by examiner

*Primary Examiner*—Holly Rickman
(74) *Attorney, Agent, or Firm*—Arent Fox, PLLC

(57) ABSTRACT

A coated paper sheet having a coating layer formed on one or two surfaces of a substrate paper sheet and containing a pigment and a binder, wherein the pigment includes kaolin particles having an average particle size of 0.3 to 1.5 $\mu$m and an aspect ratio L/W (L: major axis, W: minor axis of the particles) in the range of 5 to 50; the binder contains (a) a copolymer having a glass transition temperature Tg of 10 to 60° C. and a single phase structure and/or a synthetic polymeric compound having a core-shell composite structure; the coating layer surfaces have a 75 degree specular glossiness of 50% or more; and the air permeability of the coated paper sheet is 7000 seconds or less, is useful as printing sheet especially for gravure printing.

4 Claims, No Drawings

COATED PAPER SHEET

BACKGROUND OF THE INVENTION

1. Field of the Invention

The present invention relates to a coated paper sheet. More particularly, the present invention relates to a coated paper sheet having a high gloss, an excellent receiving property for ink transferred by a gravure printing procedure and superior reproducibility of halftone dots.

2. Description of the Related Art

It is known that, as printing paper sheets for gravure printing, coated paper sheets having a substrate sheet and a coating layer formed on the substrate sheet and comprising, as a principal components, a pigment and a binder are practically employed to obtain printed images having satisfactory clarity and color density. The conventional coated paper sheets are classified into three groups in accordance with degree of gloss, namely, mat coated paper sheets having a low gloss (a 75 degree specular gloss of 20% or less), dull coated paper sheets (having a 75 degree specular gloss of more than 20% but not more than 45%, and gloss paper sheets having a high gloss (a 75 degree specular gloss of 45% or more). Particularly, in the gloss paper sheets having a high gloss, the pigment-containing coating layer thereof is formed on a substrate sheet and then calendered by a super calender, and thus the surface of the coating layer is finished with a high smoothness and a high gloss. In this case, it is known that an increase in the smoothness causes the transferring property of the gravure printing ink to the resultant high smoothness surface to decrease. Namely, while the generation of dot-misses decreases, the density of the coating layer increases and thus the coating layer exhibits a decreased absorption property of a solvent, such as toluene, of the ink. As a result, the coloring material in the toluene solvent in the ink spreads on the surface of the coating layer to cause the ink dots to blot, expand or tail and, accordingly, the dot-reproducibility of the printed images to be decreased.

To decrease the frequency of the generation of dot-misses during the gravure printing procedure, delaminated kaolin particles, which have a high smoothness, are usually used as a principal component of the pigment for the coating layer of the coated paper sheet. However, even when the delaminated kaolin particles are contained in a high content in the coating layer, the resultant coating layer exhibits a high frequency of generation of dot-misses, namely, formation of portions of the ink images on which portions the ink is not transferred, and thus the resultant coated paper sheets are unsatisfactory in practical use.

To solve the above-mentioned problems, various attempts have been made. For example, a coated paper sheet provided with a coating layer containing a pigment having a low bulk density (0.2 to 0.6 g/cm$^2$) as disclosed in Japanese Unexamined Patent Publication No. 9-188998 and thus having an increased cushioning property is known. Also, a coated paper sheet disclosed in Japanese Unexamined Patent Publication No. 6-065,896 and provided with a coating layer containing cubical crystalline precipitated calcium carbonate particles having a BET specific surface area of 1.5 to 4.5 m$^2$/g is known. This coated paper sheet exhibits an increased cushioning property. However, a problem such that, when the above-mentioned coated paper sheets are subjected to a high speed printing machine, the frequency of generation of dot-misses in the printed ink images is high, is known.

SUMMARY OF THE INVENTION

An object of the present invention is to provide a coated paper sheet having a high gloss and capable of recording thereon ink images having a high dot reproducibility (namely excellent resistance to ink-blotting and dot-enlarging) and an excellent clarity, particularly in gravure printing procedure, without dot-misses, namely defective transfer of ink dots. The above-mentioned object can be attained by the coated paper sheet of the present invention which comprises a substrate paper sheet and a coating layer, formed on at least one surface of the substrate paper sheet and comprising a pigment and a binder, wherein, the pigment in the coating layer comprises kaolin particles having an average particle size of 0.3 to 1.5 $\mu$m and satisfying the requirement represented by the equation (1):

$$5 \leqq L/W \leqq 50 \quad (1)$$

wherein L represents a major axis of the kaolin particles and W represents a minor axis of the kaolin particles;

the binder in the coating layer comprises at least one member selected from the group consisting of (a) copolymers having a glass transition temperature of 10 to 60° C. and a single phase structure and (b) synthetic polymeric compounds having a core-shell composite structure;

the surface of the coating layer exhibits a 75 degree specular glossiness of 50% or more, determined in accordance with Japanese Industrial Standard Z8741-1997; and the coated paper sheet exhibits an air permeability of 7000 seconds or less, determined in accordance with Japanese Industrial Standard P8117-1980.

In the coated paper sheet of the present invention, the kaolin particles are preferably present in an amount of 30 parts or more by mass per 100 parts by mass of the total amount of the pigment contained in the coating layer.

In the coated paper sheet of the present invention, the synthetic polymeric compound (b) having the core-shell composite structure and contained, as a binder, in the coating layer preferably satisfies the requirements represented by the inequalities (2) and (3):

$$Tg1 < Tg2 \quad (2)$$

and $$-10° \text{ C.} < Tg2 < 100° \text{ C.} \quad (3)$$

wherein Tg1 represents a glass transition temperature of a core segment of the synthetic polymeric compound (b), and Tg2 represents a glass transition temperature of a shell segment of the synthetic polymeric compound (b).

In the coated paper sheet of the present invention, the synthetic polymeric compound (b) having the core-shell composite structure and contained, as a binder, in the coating layer is preferably present in an amount of 2 to 25 parts by mass per 100 parts by mass of the total amount of the pigment.

In the coated paper sheet of the present invention, the copolymer (a) having the glass transition temperature of 10 to 60° C. and the single phase structure and contained, as a binder, in the coating layer is preferably present in an amount of 2 to 25 parts by mass per 100 parts by mass of the total amount of the pigment.

The coated paper sheet of the present invention may be surface-smoothed by a calendering treatment at a calendering roll surface of 80° C. or more.

DESCRIPTION OF PREFERRED EMBODIMENTS

The inventors of the present invention have made extensive study to attain the above-mentioned object and found that in a coated paper sheet comprising a substrate paper sheet and a coating layer formed on at least one surface of the substrate paper sheet and comprising a pigment and a binder, the dot-missing phenomenon in the printing procedure, particularly gravure printing procedure can be prevented or restricted by using, as a pigment in the coating layer comprises kaolin particles having an average particle size of 0.3 to 1.5 $\mu$m and satisfying the requirement represented by the equation (1):

$$5 \leqq L/W \leqq 50 \quad (1)$$

wherein L represents a major axis of the kaolin particles and W represents a minor axis of the kaolin particles;

by using, as a binder for the coating layer, at least one member selected from the group consisting of (a) copolymers having a glass transition temperature of 10 to 60° C. and a single phase structure and (b) synthetic polymeric compounds having a core-shell composite structure;

by controlling the 75 degree specular glossiness of the surface of the coating layer to 50% or more, determined in accordance with Japanese Industrial Standard Z8741-1997; and by adjusting the air permeability of the coated paper sheet to 7000 seconds or less, determined in accordance with Japanese Industrial Standard P8117-1998. The present invention was completed on the basis of the above-mentioned finding.

The close adhesion between the surface of the coating layer and a surface of a gravure printing plate is enhanced with increase in the smoothness of the coating layer surface and thus with increase in the gloss of the coating layer surface. The enhancement in the above-mentioned adhesion causes the transferring efficiency of the ink during the gravure printing procedure to increase and thus the generation of the dot-missing phenomenon to be prevented or restricted. In the coated paper sheet of the present invention, the prevention or restriction of the dot-missing phenomenon can be attained by including a binder comprising at least one member selected from (a) copolymers having a glass transition temperature of 10 to 60° C. and a single phase structure and (b) synthetic polymeric compounds having a core-shell composite structure.

The core-shell composite structure consists of a core segment consisting of a homopolmeric or copolymeric component in the form of a small ball and a shell segment surrounding the core segment and consisting of a homopolymeric or copolymeric component.

The single phase structure is a structure consisting of two or more comonomers copolymerized with each other and in the form of a non-core-shell composite.

In the coating layer of the coated paper sheet of the present invention, the copolymer (a) having a glass-transition temperature of 10 to 60°, preferably 15 to 50° C. and a single phase structure, and usable as a binder is preferably selected from the group consisting of styrene-butadiene copolymers, acrylic copolymers, styrene-acryl copolymers, vinyl acetate copolymers, and ethylene-vinyl acetate copolymer.

The synthetic polymeric compounds (b) having the core-shell composite structure usable, as a binder, for the present invention preferably satisfies the requirements represented by the inequalities (2) and (3):

$$Tg1 < Tg2 \quad (2)$$

and $$-10° C. < Tg2 < 100° C. \quad (3)$$

wherein Tg1 represents a glass transition temperature of a core segment of the synthetic polymeric compound (b) and Tg2 represents a glass transition temperature of a shell segment of the synthetic polymeric compound (b). Namely, in this preferable embodiment of the coated paper sheet of the present invention, the glass transition temperature Tg2 of the shell segment is higher than the glass transition temperature Tg1 of the core segment, and the glass transition temperature Tg2 of the shell segment is more than −10° C. and less than 100° C. Thus, when a coating layer is formed from the synthetic polymeric compound (b) having the core-shell composite structure, the surface of the coating layer is substantially formed from the shell segments having the glass transition temperature Tg2. After the coating layer is formed, the core segments having a lower glass transition temperature Tg1 are surrounded by the shell segments having a higher glass transition temperature Tg2, and exhibit high softness, flexibility and elasticity at room temperature. When the coating layer is subjected to an external compression, the core segments of the synthetic polymeric compounds (b) are easily deformed and when the external compression is released, the core segments are easily returned to the original form. Thus, the coating layer exhibits a high cushioning property for the external compression. Accordingly, during the gravure printing procedure, the coating layer of the coated paper sheet is closely adhered to the gravure printing plate under printing compressive pressure and, thus, the ink is transferred from the printing plate to the coating layer surface with a high efficiency. In this connection, if the glass transition temperature Tg2 of the shell segment of the synthetic polymeric compound (b) is 100° C. or more, the synthetic polymeric compound (b) may exhibit an insufficient film-forming property. Also, if the glass transition temperature Tg2 of the shell segment is −10° C. or less, the resultant coating layer may be sticky and thus the resultant coated paper sheet may exhibit an unsatisfactory resistance to blocking phenomenon.

The glass transition temperature Tg2 of the shell segments is preferably in the range of from 0° C. to 75° C. Particularly, the glass transition temperature Tg2 of the shell segments is preferably 5° C. or more above the glass transition temperature Tg1 of the core segments. If the difference between the Tg2 and the Tg1 is less than 5° C., the resultant coating layer may exhibit an insufficient cushioning effect and the preventing effect of the coating layer on the dot-missing phenomenon may be unsatisfactory.

The synthetic polymeric compound (b) having the core-shell composite structure usable for the present invention is available in the trade as core-shell type copolymer latices. In this case, the latex particles preferably have a particle size of 40 to 300 nm. If the particle size is more than 300 nm, the resultant coating layer may exhibit an insufficient mechanical strength. Also, the synthetic polymeric compound (b) having the core-shell composite structure preferably has a content of toluene-insoluble fraction of 30% by mass or more. If the content is less than 30% by mass, and when the resultant coated paper sheet is subjected to a gravure printing procedure, the synthetic polymeric compound contained in the coating layer may be swollen with a solvent contained in the gravure ink, and the gravure printed coating layer may exhibit an insufficient mechanical strength.

The synthetic polymeric compound (b) having the core-shell composite structure can be prepared by the processes shown below.

The processes for producing the latices of the synthetic polymeric compound (b) having the core-shell composite structure are disclosed in Japanese Unexamined Patent Publications No. 62-117,897, No. 7-324,112 and No. 9-31,141. For example, an aliphatic conjugated diene monomer and at least one comonomer different from and copolymerizable with the above-mentioned conjugated diene monomer are copolymerized with each other by an emulsion polymerization method, to provide a copolymer for a core segment, and then, in the presence of the copolymer latex, at least one comonomer copolymerizable with the above-mentioned monomers for the core segment, selected from, for example, aliphatic conjugated diene monomers, aromatic vinyl monomers, and ethylenically unsaturated carboxylic monomers, are copolymerized with each other by an emulsion polymerization method, to provide a polymer or copolymer for a shell segment copolymerized with the core segment copolymer and surrounding the core segment. A synthetic polymeric compound (b) having a core-shell composite structure is obtained.

The comonomer for the core segment is preferably selected from aliphatic conjugated diene monomers, aromatic vinyl monomers and ethylenically unsaturated carboxylic monomers.

The aliphatic conjugated diene monomers usable for the core and shell segments include, for example, butadiene, isoprene and 2-chloro-1,3-butadiene. The aromatic vinyl monomers for the core and shell segments include, for example, styrene, methyl styrene, vinyl toluene and chlorostyrenes. The ethylenically unsaturated carboxylic monomers include, for example, acrylic acid, methacrylic acid, crotonic acid, maleic acid and itaconic acid.

The synthetic polymeric compound (b) having the core-shell composite structure can be produced by a conventional emulsion polymerization method using an emulsifying agent, a polymerization-initiator and a molecular weight-regulator contained in an aqueous medium. The emulsifying agent include anionic surfactants, nonionic surfactants and amphoteric surfactances which may be employed alone or in a mixture of two or more thereof.

The polymerization can be carried out, in the same manner as a seed polymerization, by preparing a copolymer for the core segment in a polymerization system; introducing a certain amount of the copolymer for the core segment into a other polymerization system; and copolymerizing at least one monomer in the presence of the copolymer for the core segment in the other polymerization system to prepare a polymer for the shell segment copolymerized with the core segment copolymers. Alternatively, two or more comonomers for the core segment and at least one monomer for the shell segments are placed in one the same polymerization reactor and they are subjected to a multiple-step polymerization procedure in which a copolymer for the core segment is produced and then polymers for the shell segments are polymerized in the presence of the copolymer for the core shell segment.

The synthetic polymeric compound (b) having the core-shell composite structure in the state of a latex, has a core copolymer segment having a lower glass transition temperature Tg1 and a shell copolymer segment having a higher glass transition temperature Tg2, enables the resultant coating layer to have desired properties. Namely, in the coated paper sheet of the present invention, when the synthetic polymeric compound (b) having a core-shell composite structure is employed as a component of a binder for the coating layer, the synthetic polymeric compound (b) has a core segment having a low glass transition temperature and thus enables the coating layer to exhibit a high cushioning property in response to a compressive pressure applied to the coating layer when the resultant coated paper sheet is subjected to a gravure printing procedure, and thus the coating layer surface to be brought into close contract with the gravure printing plate.

The inventors of the present invention further have extensively studied the relationship between the smoothness of the coating layer surface and the generation of the dot-misses, to prevent or restrict the generation of the dot-misses. As a result, the inventors have succeeded to obtain a coating layer having high gloss and smoothness and a high air-permeability and to significantly decrease the generation frequencies of the dot-missing phenomenon and the dot-blotting phenomenon, by employing, as a principal component of the pigment contained in the coating layer, kaolin particles having an aspect ratio in the range of from 5 to 50, preferably from 5 to 15, the aspect ratio being defined as a ratio of a major axis to a minor axis of the pigment particles, measured on a flat plate, and an average particle size in the range of from 0.3 to 1.5 $\mu$m, preferably from 0.3 to 1.2 $\mu$m, and preferably by controlling the content of the kaolin particles to 30 parts or more by mass, preferably 35 parts by mass or more, per 100 parts by mass of the total amount of the pigment.

Even when the kaolin particles have an average particle size of 0.3 to 1.5 $\mu$m, if the aspect ratio of the kaolin particles is less than 5, the resultant coating layer is difficult to obtain a satisfactory gloss and a sufficient smoothness, and the frequency of the dot-missings may increase. Also, if the aspect ratio of the kaolin particles is more than 50, while the resultant coating layer has a sufficient gloss, the air-permeability thereof is insufficient and thus the ink dot-blottings is insufficiently prevented or restricted.

Reasons of enabling the specific kaolin particles to realize a coating layer having high smoothness and gloss and a low air permeability, is assumed to be as follows. Since the aspect ratio of the kaolin particles usable for the present invention is in the range of from 5 to 50, the minor axis of the kaolin particles for the present invention is relatively large in comparison with the conventional delaminate kaolin particles having an aspect ratio of more than 50, and the kaolin particles for the present invention have a relatively large average particle size of 0.3 to 1.5 $\mu$m and a hexagonal plate crystal form which causes the kaolin particles to have a high uniformity in particle size distribution. Accordingly, the smoothing treatment for the coating layer does not cause the gaps between the pigments accumulated on each other to decrease and the density of the coating layer to not increase, and the resultant coating layer has a high smoothness derived from the hexagonal plate crystal particles.

Where the kaolin particles having the aspect ratio in the range of from 5 to 50 have an average particle size of 0.3 $\mu$m or less, the resultant coating layer exhibits a significantly decreased air permeability, while it is easy to impart a high gloss to the coating layer. Where the kaolin particles have an average particle size of 1.5 $\mu$m or more, it is difficult to impart a high gloss to the coating layer and thus, to provide the coating layer having a desired high gloss. Also, in particle size distribution, preferably, the distribution frequency of the particles having a particle size in the range of from 0.3 to 1.5 $\mu$m in the pigment particles contained in the coating layer is 65% or more.

In the coated paper sheet of the present invention, the content of the kaolin contained, as a principal component of the pigment in the coating layer is preferably 30 parts by mass or more, more preferably 35 to 100 parts by mass, per 100 parts by mass of the total amount of the pigment. When the content is less than 30 parts by mass, the resultant coating layer may exhibit an insufficient air permeability.

In the coated paper sheet, there is no limitation to the production process and type of the pulp from which the substrate paper sheet is produced. For example, the substrate paper sheet is produced from, for example, chemical pulps, for example, KP, mechanical pulps, for example, SGP, RGP, BCTMP and CTMP, waste paper pulps, for example, deinking pulps, and non-wood pulps, for example, kenaf, bamboo, straw, flax and jute pulps. Also, the pulps may be used in combination with at least one member selected from synthetic organic fibers, for example, polyamide and polyester fibers, regenerated fibers, for example, polynosic fibers, and inorganic fibers, for example, glass, ceramic and carbon fibers. Preferably, chlorine-free pulps, for example the ECF pulp and TCF pulp are employed as pulp for forming the substrate paper sheet.

The substrate paper sheet optionally contains a filler. The filler may comprises at least one member selected from various types of pigments commonly used in woodfree paper sheets. The pigments usable as the filler include mineral pigments, for example, kaolin, calcined kaolin, calcium carbonate, calcium sulfate, barium sulfate, titanium dioxide, talc, zinc oxide, alumina, magnesium carbonate, magnesium oxide, silica, white carbon, bentonite, zeolite, sericite and smectites; and organic hollow, filled and perforated fine pigment particles of polystyrene resins, urea-formaldehyde resins, melamine-formaldehyde resins, acrylic polymer resins, and vinylidene chloride polymer resins.

In the production of the substrate paper sheet, the paper-forming material slurry is optionally mixed with one or more additives for the paper-making process, for example, anionic, nonionic, cationic and ampholytic yield-enhancing agents, filtration-enhancing agents, strength-enhancing agents and inner sizing agents. The pulp slurry for the substrate paper sheet optionally further contains one or more additives for paper-forming process, selected from, for example, dyes, fluorescent brightening agents, pH-regulator, antifoaming agents, pitch-controlling agents, and slime-controlling agents.

There is no limitation to the methods of producing the substrate paper sheet. The substrate paper sheet may be produced by any paper-making method, including acid paper-making methods in which the paper formation is carried out at a pH of about 4.5, and neutral paper-making forming methods in which the pulp slurry contains an alkaline filler, for example, calcium carbonate, and the paper formation is carried out in the pH range of from a weak acidic pH value of about 6 to a weak alkaline pH value of about 9. The paper-producing machine can be selected from Fourdrinier paper machines, twine-wire paper machines, cylinder paper machines, and Yankee paper machine.

The pigment usable for the coating layer of the coated paper sheet of the present invention, in addition to the above-mentioned kaolin, comprises at least one member selected from mineral pigments, for example, ground calcium carbonate, precipitated calcium carbonate, kaolins different in the aspect ratio (L/W) and/or the average particle size from the kaolin usable for the present invention, calcined kaolin, delaminated kaolin, talc, calcium sulfate, barium sulfate, titanium dioxide, zinc oxide, alumina, magnesium carbonate, magnesium oxide, silica, magnesium aluminosilicate, particulate calcium silicate, particulate magnesium carbonate, particulate precipitated calcium carbonate, white carbon, bentonite, zeolite, sericite and smectites; and organic hollow, perforated and non-perforated fine pigment particles of polystyrene resins, styrene-acryl copolymer resins, urea-formaldehyde resins, melamine-formaldehyde resins, acrylic polymer resins, vinylidene polymer resins and benzoquanamine resins.

Each of the above-mentioned pigment particles is preferably in the form of a sphere. The spherical pigment particles preferably have a particle size of from 3.0 to 20.0 $\mu$m so as to cause the resultant coating layer surface to have 10 to 1000 convexities per $MM^2$.

The spherical pigment particles are preferably selected from spherical precipitated calcium carbonate particles and spherical magnesium carbonate particles.

The fine, hollow, perforated, and non-perforated spherical organic pigment particles are preferably formed from at least one selected from polystyrene resins, styrene-acrylic comonomer resins, urea-formaldehyde resins, melamine-formaldehyde resins, acrylic resins, vinylidene chloride polymer resins, and benzoquanamine resins. The above-mentioned pigments may be employed alone or in a mixture of two or more thereof.

In the coated paper sheet of the present invention, the binder contained in the coating layer optionally further contains, in addition to the copolymer (a) having a signal phase structure and/or the synthetic polymeric compound (b) having the core-shell composite structure, at least one polymeric compound selected from water-soluble and water-dispensable polymeric compounds different from the synthetic polymeric compound (b) and the copolymer (a). The additional binder compound can be selected from natural and semisynthetic polymeric compounds, for example, starch compounds, for example, cationic starches, ampholic starches, oxidized starches, enzyme-modified starches, thermochemically modified starches, esterified starches and etherified starches, cellulose derivatives, for example, carboxymethyl cellulose and hydroxyethyl cellulose, gelatin, casein, soybean protein and natural rubber, and synthetic polymeric compounds, for example, polyvinyl alcohol, polydienes, for example, isoprene polymers, neoprene polymers, and polybutadiene, polyalkenes, for example, polybutene, polyisobutylene, polypropylene, and polyethylene, vinyl polymers and copolymers, for example, polymers and copolymers of vinyl halides, vinyl acetate, styrene, (meth)acrylic acid, (meth)acrylate esters, (meth) acrylamide, and methylvinylether, synthetic rubber latices, for example, latices of styrene-butadiene copolymers, and methyl methacrylate-butadiene copolymers, polyurethane resins, polyester resins, polyamide resins, olefin-maleic anhydride copolymer resins and melamine-formaldehyde resins. These polymeric compounds for the additional binder component may be employed alone or in a mixture of two or more thereof.

In the production of the coated paper sheet of the present invention, the content of the synthetic polymeric compound (b) having the core-shell composite structure and/or the copolymer (a) having the single phase structure in the binder contained in the coating liquid for the coating liquid is preferably in the range of from 2 to 25 parts by solid mass per 100 parts by solid mass of the total amount of the pigment. If the content is less than 2 parts by solid mass, the mechanical strength of the resultant coating layer may be insufficient and thus cause the coating layer to be partially peeled off, the peeled portions of the coating layer to be accumulated on the printing plate of the rotary gravure printing machine, and the printing plate to be damaged by the accumulated coating layer portions. Also, if the content exceeds 25 parts by solid mass, the resultant coating layer may exhibit a significantly insufficient air permeability and may cause the printed ink images on the coating layer to exhibit an insufficient resistance to blotting of the ink.

In the resultant coating layer of the coated paper sheet of the present invention, the content of the synthetic polymeric compound (b) having the core-shell composite structure and/or the copolymer (a) having the single phase structure is also in the range of from 2 to 25 parts by mass per 100 parts by mass of the total amount of the binder in the coating layer.

The coating layer optionally further contains, in addition to the pigment and the binder, an additive comprising at least one member selected from, for example, surfactants, pH-regulators, viscosity-modifiers, softening agents, gloss-enhancing agents, waxes, dispersing agents, fluidity-modifiers, stabilizers, anti-static agent, cross-linking agents, sizing agents, fluorescent brightening agents, coloring materials, ultraviolet ray-absorbers, anti-foaming agents, water-resisting agents, plasticizers, lubricants, preservatives and scenting agents.

In the coated paper sheet of the present invention, the coating layer is preferably present in an amount of 8 to 20 g/m$^2$, more preferably 9 to 15 g/m$^2$. If the amount of the coating layer is less than 8 g/m$^2$, the resultant coating layer may not sufficiently cover and smooth the rough surface of the substrate paper sheet, and thus may exhibit an unsatisfactory receiving property for the printing ink. Also, the amount of the coating layer is more than 20 g/m$^2$, the drying property of the coating liquid layer may be insufficient to cause the coating efficiency to be low and the production cost of the coated paper sheet to be too high.

The coating procedure for the coating layer can be carried out by using any one of the conventional coating apparatuses, for example, blade coaters, air knife coaters, roll coaters, reverse roll coaters, bar coaters, curtain coaters, die slot coaters, gravure coaters, champlex coaters, brush coaters, two roll-type and metering blade type sizepress coaters, bill blade coaters, short dwell coaters, lip coaters and gate roll coaters.

The coating layer may be formed on both the front and back surfaces of the substrate paper sheet and/or in a multi-layered structure. The multi-layered coating layer can be formed by forming one or more intermediate coating layers on a surface of the substrate paper sheet, and an outermost coating layer is formed on the intermediate coating layer or layers. When the coating layer is formed on the two surfaces of the substrate paper sheet or in the multi-layered structure, the compositions and amount of a plurality of the coating layers may be the same as each other or different from each other. The composition of each coating liquid may be designed in consideration of the purpose and the desired properties of the coating layer. When the coating layer is formed on only a front surface of the substrate paper sheet, the back surface of the substrate paper sheet may be coated with a synthetic resin layer, a pigment-binder mixture layer, or an anti-static layer. The above-mentioned back coating layer contributes to enhancing a resistance to curling, the printing-applicability and a resistance to blocking of feeding and/or delivering of the coated paper sheets into or from the printer. The back surface of the substrate paper sheet may be treated with an adhesive, a magnetic material, a flame retardant agent, a thermal resistant agent, a water-proofing agent, an oil-proofing agent or an anti-slipping agent to impart a desired function to the back surface of the coated paper sheet.

In the production procedure of the coated paper sheet of the present invention, the coating layer is formed on the substrate paper sheet, and thereafter the surface of the coating layer is smoothed during a drying procedure and/or a surface-treatment procedure. Also, the water content of the coating layer is preferably adjusted to 3 to 10% by mass, more preferably about 4 to 8% by mass, to finish the coated paper sheet.

In the smoothing procedure, a conventional smoothing apparatus, for example, a super calender, gloss calender, or a soft calender may be employed on machine or off machine. The type of the smoothing apparatus and the number of nipping operations and the smoothing temperature applied to the coated paper sheet can be controlled with reference to the practice of the usual smoothing procedure. The surface temperature of the calender roll is preferably controlled to 80° C. or more, more preferably 100° C. or more.

In the coated paper sheet of the present invention, the 75 degree specular glossiness of the surface of the coating layer must be controlled to 50% or more, preferably 55% or more, determined in accordance with Japanese Industrial Standard (JIS) Z 8741-1997, and the air permeability of the coated paper sheet must be controlled to 7000 seconds or less, preferably 5000 seconds or less, more preferably 3000 seconds or less, determined in accordance with JIS P 8117-1980.

When used as a printing paper sheet, the coated paper sheet must be capable of smoothly passing through the printer. For this purpose, the coated paper sheet of the present invention preferably has a clark stiffness of 12 cm or more, more preferably 15 cm or more, in the transverse (cross) direction (which is represented by CD direction hereinafter) of the paper sheet.

The coated paper sheet of the present invention produced by the above-mentioned procedures has a high applicability to the gravure printing and is usable as an image-receiving paper sheet for no-impact printing systems, for example, electrophotographic printing systems and thermal transfer printing systems due to a high smoothness and the high air permeability of the coated paper sheet.

EXAMPLES

The present invention will be further illustrated by the following examples which are not intended to restrict the scope of the present invention in any way.

Example 1

[Preparation of a Substrate Paper Sheet]

A hardwood kraft pulp (LBKP) having a Canadian Standard freeness (CSF) of 450 ml in an amount of 100 parts by mass were mixed with 0.05 part by mass of an inner sizing agent consisting of alkenyl succinic anhydride (Trademark: FIVERUN 81K, made by ARAKAWA KAGAKUKOGYO K.K.), 0.7 part by mass a fixing agent consisting of an cationic starch (Trademark: CATO F, made by NIHON NSC K.K.), and 0.5 part by mass of aluminum sulfate and then with 10 parts by mass of a filler consisting of calcium carbonate. The resultant mixture was further mixed with white water to provide a paper-forming pulp slurry having a pH value of 7 and a solid content of 0.8% by mass. The pulp slurry was fed into a paper-producing procedure using a Fourdrinier paper-machine. The resultant wet paper sheet was coated with a sizepress liquid containing 6% by mass of a sizing agent consisting of oxidized starch (Trademark: ACE A, made by OJI CORN STARCH K.K.) and dried by using a sizepress machine to size the paper sheet with the sizing agent in a dry solid amount of 2 g/m$^2$. The resultant paper sheet was subjected to a smoothing procedure using a machine calender to control the Bekk smoothness of the paper sheet to 50 seconds. A substrate paper sheet having a basis weight of 80 g/m$^2$ was obtained.

[Preparation of a Coating Liquid]

An aqueous pigment slurry was prepared by mixing 70 parts by mass of a kaolin pigment (Trademark: KAOGLOSS, made by IMERIS CO.) with 30 parts by mass of ground calcium carbonate pigment (Trademark: HYDROCARB 9, made by BIHOKU FUNKAKOGYO K.K.) and 0.2 part by mass of a dispersing agent consisting of sodium polyacrylate (Trademark: ARON A-9, made by TOA GOSEI K.K.) and by dispersing the resultant mixture in water by using a Cowless disperser. The pigment slurry was mixed with 3.0 parts by mass of an oxidized starch (Trademark: ACE A, made by OJI CORN STARCH K.K.) and 10 parts by mass of a styrene-butadiene copolymer latex having a core-shell composite structure, a core segment glass transition temperature Tg1 of −10° C. and a shell segment glass transition temperature Tg2 of +28° C. (Trademark: S2524, made by JSR CO.); and the mixture was stirred and further mixed with water to provide a coating liquid having a dry solid content of 60% by mass. Table 1 shows the properties of the binder as mentioned above and Table 2 shows the composition, particle form, aspect ratio, average particle size and particle size distribution of the above-mentioned pigment particles.

[Formation of a Coating Layer on the Substrate Paper Sheet]

The above-mentioned coating liquid was coated on the front and back surfaces of the substrate paper sheet by using a blade coater and dried to form front and back coating layers each having a dry solid amount of 12 g/m$^2$. The resultant coated paper sheet was calendered by a calender having a metal roll in combination with an elastic roll to smooth the front surface of the coated paper sheet. The calendered coated paper sheet exhibited a 75 degree specular gloss of 65% determined in accordance with JIS Z 8741, and had a basis weight of 104 g/m$^2$.

Example 2

A coated paper sheet was produced by the same procedures as in Example 1, except that the kaolin pigment (Trademark: KAOGLOSS) was replaced a structural kaolin pigment (Trademark: ASTRAPLUS, made by IMERIS CO.), having the composition, particle form, aspect ratio, average particle size and particle size distribution shown in Table 2.

Example 3

A coated paper sheet was produced by the same procedures as in Example 1, except that the kaolin pigment (Trademark: KAOGLOSS) was replaced a delaminated kaolin pigment (Trademark: ASTRAPLATE, made by IMERIS CO.), having the composition, particle form, aspect ratio, average particle size and particle size distribution shown in Table 2.

Example 4

A coated paper sheet was produced by the same procedures as in Example 2, except that the styrene-butadiene copolymer latex (Trademark: S2524) was replaced by another styrene-butadiene copolymer latex (Trademark: P8892, made by SUMIKA A & L CO.) having a core-shell composite structure, a core segment glass transition temperature Tg1 of −5° C. and a shell segment glass transition temperature Tg2 of +60° C., the calendering procedure was carried out by using a soft nip calender at a calender treatment temperature of 150° C. to control the 75 degree specular gloss of the calendered front surface to 65%. The resultant coated paper sheet had a basis weight of 104 g/m$^2$.

Example 5

A coated paper sheet was produced by the same procedures as in Example 2, except that the styrene-butadiene copolymer latex (Trademark: S2524) was replaced by another styrene-butadiene copolymer latex (Trademark: T2702F, made by JSR CO.) having a core-shell composite structure, a core segment glass transition temperature Tg1 of −45° C. and a shell segment glass transition temperature Tg2 of +10° C.

Example 6

A coated paper sheet was produced by the same procedures as in Example 2, except that the styrene-butadiene copolymer latex (Trademark: S2524) was replaced by another styrene-butadiene copolymer latex (Trademark: T2699B, made by JSR CO.) having a core-shell composite structure, a core segment glass transition temperature Tg1 of −35° C. and a shell segment glass transition temperature Tg2 of 0° C.

Example 7

A coated paper sheet was produced by the same procedures as in Example 2, except that the structural kaolin pigment (Trademark: ASTRAPLUS, made by IMERIS CO.) was employed in an amount of 95 parts by mass in combination with 5 parts by mass of a ground calcium carbonate pigment (Trademark: HYDROCARB K9, made by BIHOKU FUNKAKOGYO K.K.).

Example 8

A coated paper sheet was produced by the same procedures as in Example 2, except that the structural kaolin pigment (Trademark: ASTRAPLUS, made by IMERIS CO.) was employed in an amount of 55 parts by mass in combination with 45 parts by mass of a ground calcium carbonate pigment (Trademark: HYDROCARB K9, made by BIHOKU FUNKAKOGYO K.K.).

Example 9

A coated paper sheet was produced by the same procedures as in Example 2, except that the amount of each coating layer was changed from 12 g/m$^2$ to 8 g/m$^2$.

Example 10

A coated paper sheet was produced by the same procedures as in Example 2, except that the amount of each coating layer was changed from 12 g/m$^2$ to 16 g/m$^2$.

Example 11

A coated paper sheet was produced by the same procedures as in Example 4, except that the smoothing conditions on the soft nip calender were controlled so that the resultant smoothed front surface of the coated paper sheet exhibit a 75 degree specular gloss of 80%. The smoothing treatment temperature of the soft nip calender was 150° C.

Example 12

[Preparation of a Substrate Paper Sheet]

A hardwood kraft pulp (LBKP) having a Canadian Standard freeness (CSF) of 450 ml in an amount of 100 parts by mass were mixed with 0.05 part by mass of an inner sizing agent consisting of alkenyl succinic anhydride (Trademark: FIVERUN 81K, made by ARAKAWA KAGAKUKOGYO K.K.), 0.7 part by mass of a fixing agent consisting of an cationic starch (Trademark: CATO F, made by NIHON NSC K.K.), and 0.5 part by mass of aluminum sulfate and then with 10 parts by mass of a filler consisting of calcium carbonate. The resultant mixture was further mixed with white water to provide a paper-forming pulp slurry having a pH value of 7 and a solid content of 0.8% by mass. The pulp slurry was fed into a paper-producing procedure using a Fourdrinier paper-machine. The resultant wet paper sheet was coated with a sizepress liquid containing 6% by mass of a sizing agent consisting of oxidized starch (Trademark: ACE A, made by OJI CORN STARCH K.K.) and dried by using a sizepress machine to size the paper sheet with the sizing agent in a dry solid amount of 2 g/m$^2$. The resultant paper sheet was subjected to a smoothing procedure using a machine calender to control the Bekk smoothness of the paper sheet to 50 seconds. A substrate paper sheet having a basis weight of 56 g/m$^2$ was obtained.

[Preparation of a Coating Liquid]

An aqueous pigment slurry was prepared by mixing 35 parts by mass of a structural kaolin pigment (Trademark: ASTRAPLUS, made by IMERIS CO.) with 65 parts by mass of kaolin pigment (Trademark: KAOGLOSS, made by IMERIS CO.) with 0.2 part by mass of a dispersing agent consisting of sodium polyacrylate (Trademark: ARON A-9, made by TOA GOSEI K.K.) and by dispersing the resultant mixture in water by using a Cowless disperser. The pigment slurry was mixed with 3.0 parts by mass of an oxidized starch (Trademark: ACE A, made by OJI CORN STARCH K.K.) and 15 parts by mass of a styrene-butadiene copolymer latex having a core-shell composite structure, a core segment glass transition temperature Tg1 of −10° C. and a shell segment glass transition temperature Tg2 of +28° C. (Trademark: S2524, made by JSR CO.); and the mixture was stirred and further mixed with water to provide a coating liquid having a dry solid content of 60% by mass. Table 1 shows the properties of the binder as mentioned above and Table 2 shows the composition, particle form, aspect ratio, average particle size and particle size distribution of the above-mentioned pigment particles.

[Formation of a Coating Layer on the Substrate Paper Sheet]

The above-mentioned coating liquid was coated on the front and back surfaces of the substrate paper sheet by using a blade coater and dried to form front and back coating layers each having a dry solid amount of 12 g/m$^2$. The resultant coated paper sheet was calendered by a calender having a metal roll in combination with an elastic roll to smooth the front surface of the coated paper sheet. The calendered coated paper sheet exhibited a 75 degree specular gloss of 65% determined in accordance with JIS Z 8741 and had a basis weight of 80 g/m$^2$.

Example 13

A coated paper sheet was produced by the same procedures as in Example 13, except that the binder further contained a copolymer latex having a high glass transition temperature. Namely, the styrene-butadiene copolymer latex (Trademark: S2524, made by JSR CO.) having a core-shell composite structure, a core segment glass transition temperature Tg1 of −10° C. and a shell segment glass transition temperature Tg2 +28° C. was employed in an amount of 5 parts by mass in combination with 10 parts by mass of a styrene-butadiene copolymer latex (Trademark: POT 7092, made by NIHON ZEON K.K.), having a single phase structure and a glass transition temperature of +35° C.

Example 14

A coated paper sheet was produced by the same procedures as in Example 13, except that the surface-smoothing conditions on the soft nip calender was controlled so that the resultant calendered front surface of the coated paper sheet exhibited a 75 degree specular gloss of 80%. The calender-treatment temperature of the soft nip calender was 150° C.

Example 15

[Preparation of a Substrate Paper Sheet]

A hardwood kraft pulp (LBKP) having a Canadian Standard freeness (CSF) of 450 ml in an amount of 100 parts by mass were mixed with 0.05 part by mass of an inner sizing agent consisting of alkenyl succinic anhydride (Trademark: FIVERUN 81K, made by ARAKAWA KAGAKUKOGYO K.K.), 0.7 part by mass a fixing agent consisting of an cationic starch (Trademark: CATO F, made by NIHON NSC K.K.), and 0.5 part by mass of aluminum sulfate and then with 10 parts by mass of calcium carbonate. The resultant mixture was further mixed with white water to provide a paper-forming pulp slurry having a pH value of 7 and a solid content of 0.8% by mass. The pulp slurry was fed into a paper-producing procedure using a Fourdrinier paper-machine. The resultant wet paper sheet was coated with a sizepress liquid containing 6% by mass of a sizing agent consisting of oxidized starch (Trademark: ACE A, made by OJI CORN STARCH K.K.) and dried by using a sizepress machine to size the paper sheet with the sizing agent in a dry solid amount of 2 g/m$^2$. The resultant paper sheet was subjected to a smoothing procedure using a machine calender to control the Bekk smoothness of the paper sheet to 50 seconds. A substrate paper sheet having a basis weight of 56 g/m$^2$ was obtained.

[Preparation of a Coating Liquid]

An aqueous pigment slurry was prepared by mixing 35 parts by mass of a structural kaolin pigment (Trademark: ATRASPLUS, made by IMERIS CO.) and 65 parts by mass of a kaolin pigment (Trademark: KAOGLOSS, made by IMERIS CO.) with 0.2 part by mass of a dispersing agent consisting of sodium polyacryalte (Trademark: ARON A-9, made by TOA GOSEI K.K.) and by dispersing the resultant mixture in water by using a Cowless disperser. The pigment slurry was mixed with 3.0 parts by mass of an oxidized starch (Trademark: ACE A, made by OJI CORN STARCH K.K.) and 18 parts by mass of a styrene-butadiene copolymer latex having a single phase structure, a glass transition temperature Tg of +35° C. (Trademark: POT 7092, made by NIHON ZEON K.K.); and the mixture was stirred and further mixed with water to provide a coating liquid having a dry solid content of 60% by mass. Table 1 shows the properties of the binder as mentioned above and Table 2 shows the composition, particle form, aspect ratio, average particle size and particle size distribution of the above-mentioned pigment particles.

[Formation of a Coating Layer on the Substrate Paper Sheet]

The above-mentioned coating liquid was coated on the front and back surfaces of the substrate paper sheet by using a blade coater and dried to form front and back coating layers each having a dry solid amount of 12 g/m$^2$. The resultant coated paper sheet was calendered by a calender having a metal roll in combination with an elastic roll to smooth the front surface of the coated paper sheet. The calendered coated paper sheet exhibited a 75 degree specular gloss of 65% determined in accordance with JIS Z 8741, and had a basis weight of 80 g/m$^2$.

Example 16

A coated paper sheet was produced by the same procedures as in Example 15, except that the surface smoothing conditions on the soft nip calender were controlled so that the resultant smoothed front surface of the coated paper sheet exhibited a 75 degree specular gloss of 80%. The calender treatment temperature of the soft nip calender was 150° C.

Example 17

[Preparation of a Substrate Paper Sheet]

A hardwood kraft pulp (LBKP) having a Canadian Standard freeness (CSF) of 450 ml in an amount of 100 parts by mass were mixed with 0.05 part by mass of an inner sizing agent consisting of alkenyl succinic anhydride (Trademark: FIVERUN 81K, made by ARAKAWA KAGAKUKOGYO K.K.), 0.7 part by mass a fixing agent consisting of an cationic starch (Trademark: CATO F, made by NIHON NSC K.K.), and 0.5 part by mass of aluminum sulfate and then with 10 parts by mass of a filler consisting of calcium carbonate. The resultant mixture was further mixed with white water to provide a paper-forming pulp slurry having a pH value of 7 and a solid content of 0.8% by mass. The pulp slurry was fed into a paper-producing procedure using a Fourdrinier paper-machine. The resultant wet paper sheet was coated with a sizepress liquid containing 6% by mass of a sizing agent consisting of oxidized starch (Trademark: ACE A, made by OJI CORN STARCH K.K.) and dried by using a sizepress machine to size the paper sheet with the sizing agent in a dry solid amount of 2 g/m$^2$. The resultant paper sheet was subjected to a smoothing procedure using a machine calender to control the Bekk smoothness of the paper sheet to 50 seconds. A substrate paper sheet having a basis weight of 56 g/m$^2$ was obtained.

[Preparation of a Coating Liquid]

An aqueous pigment slurry was prepared by mixing 35 parts by mass of a structural kaolin pigment (Trademark: ASTRAPLUS, made by IMERIS CO.) and 65 parts by mass of a structural kaolin pigment (Trademark: KAOGLOSS, made by IMERIS CO.) with 0.2 part by mass of a dispersing agent consisting of sodium polyacrylate (Trademark: ARON A-9, made by TOA GOSEI K.K.) and by dispersing the resultant mixture in water by using a Cowless disperser. The pigment slurry was mixed with 3.0 parts by mass of an oxidized starch (Trademark: ACE A, made by OJI CORN STARCH K.K.) and 18 parts by mass of a styrene-butadiene copolymer latex having a single phase structure and glass transition temperature Tg of +54° C. (Trademark: NIPOL 2507, made by NIHON ZEON K.K.); and the mixture was stirred and further mixed with water to provide a coating liquid having a dry solid content of 60% by mass. Table 1 shows the properties of the binder as mentioned above and Table 2 shows the composition, particle form, aspect ratio, average particle size and particle size distribution of the above-mentioned pigment particles.

[Formation of a Coating Layer on the Substrate Paper Sheet]

The above-mentioned coating liquid was coated on the front and back surfaces of the substrate paper sheet by using a blade coater and dried to form front and back coating layers each having a dry solid amount of 12 g/m$^2$. The resultant coated paper sheet was calendered by a soft nip calender at a calendering temperature of 150° C. to smooth the front surface of the coated paper sheet. The calendered coated paper sheet exhibited a 75 degree specular gloss of 80% determined in accordance with JIS Z 8741, and had a basis weight of 80 g/m$^2$.

Example 18

A coating liquid was prepared by the same procedures as in Example 17, except that the styrene-butadiene copolymer latex (Trademark: NIPOL 2507) was replaced by 18 parts by mass of another styrene-butadiene copolymer latex (Trademark: OX 1103, made by NIHON ZEON) having a single phase structure and a glass transition temperature Tg of +24° C.

The coating liquid was coated on the front and back surfaces of the same substrate paper sheet as in Example 17 by using a blade coater and dried to form front and back coating layers each having a dry solid amount of 12 g/m$^2$. The resultant coated paper sheet was smoothed by using a soft nip calender to an extent such that the smoothed front surface exhibited a 75 degree specular gloss of 80%, in the same manner as in Example 17. The calender treatment temperature of the soft nip calender was 150° C.

Comparative Example 1

A coated paper sheet was produced by the same procedures as in Example 1, except that the styrene-butadiene copolymer latex (Trademark: S2524) having a core-shell composite structure was replaced by another styrene-butadiene copolymer latex (Trademark: G1176; made by ASAHI KASEIKOGYO K.K.) having a homogeneous single phase structure and a glass transition temperature Tg of −52° C.

Comparative Example 2

A coated paper sheet was produced by the same procedures as in Example 1, except that the styrene-butadiene copolymer latex (Trademark: S2524) having a core-shell composite structure was replaced by another styrene-butadiene copolymer latex (Trademark: T 2550K; made by JSR CO.) having a homogeneous single phase structure add a glass transition temperature Tg of −14° C.

Comparative Example 3

A coated paper sheet was produced by the same procedures as in Example 1, except that the amount of the kaolin pigment (Trademark: KAOGLOSS) in the coating liquid changed from 70 parts by mass to 90 parts by mass, and 10 parts by mass of a ground calcium carbonate pigment (Trademark: HYDROCARB K9, made by BIHOKU FUNKAKOGYO K.K.) were further contained in the coating liquid.

Comparative Example 4

A coated paper sheet was produced by the same procedures as in Example 1, except that in the preparation of the coating liquid, the kaolin pigment (Trademark: KAOGLOSS) was employed in 20 parts by mass, and a ground calcium carbonate pigment (Trademark: HYDROCARB K9; made by BIHOKU FUNKAKOGYO K.K.) was further employed in an amount of 80 parts by mass, and in the calender-smoothing treatment, it was tried to impart a 75 degree specular gloss of 65%, determined in accordance with JIS Z 8741, by using a nipping apparatus having a metal roll and an elastic roll under pressure to the front surface of the coated paper sheet.

As a result, a 75 degree specular gloss of 45% or more could not be obtained.

Comparative Example 5

A coated paper sheet was produced by the same procedures as in Example 1, except that the kaolin pigment (Trademark: KAOGLOSS) used as an inorganic pigment was replaced by a precipitated calcium carbonate pigment (Trademark: BRILLIANT S15, made by SHIROISHI CALCIUM K.K.). The component, particle form, aspect ratio, average particle size and particle size distribution of the pigment are shown in Table 2.

Tests

Samples of the coated paper sheets produced in the examples and the comparative examples were subjected to the following tests. The test results are shown in Table 3.

[Measurements of Average Particle Size and Particle Size Distribution of Pigment Particles]

The measurements were carried out by using a tester (Trademark: SEDY GRAPH 5100, V3.07).

[Measurement of Aspect Ratio of Pigment Particles and Observation of Particle Form]

The aspect ratio of the pigment particles and the observation of the pigment particle form were carried out at a magnification of 15,000 by using an electron microscope.

[Measurements of Gloss and Air Permeability of Coated Paper Sheet]

The specular glossiness of the coated paper sheet was measured at an angle of incidence of 75 degrees at a receiving light angle of 75 degrees, in accordance with JIS Z 8741-1997, by using a gloss meter (model GM-26D, made by MURAKAMI SHIKISAI KENKYUSHO).

The air permeability of the coated paper sheet was measured in accordance with JIS P 8117-1998.

[Evaluation in Dot-Missing-Preventing Property and Dot-Reproducibility of the Coated Paper Sheet]

The dot-missing-preventing property and dot-reproducibility of the coated paper sheet was tested in accordance with JIS P 8117-1998, and the printed paper sheet and images were evaluated by the naked eye in the following classes.

(a) Dot-missing-preventing property

| Class | Dot-missing S |
|---|---|
| 4 | No defect in dots is found. Printed images are clear. |
| 3 | Slight defects in dots are found. Printed images are practically usable. |
| 2 | Certain defects in dots are found. Printed images have a low clarity. |
| 1 | Significant defects in dots are found. Printed images are unclear. |

(b) Dot-reproducibility

| Class | Dot-reproducibility |
|---|---|
| 4 | No blotting and enlarging of dots are found. Printed images are clear. |
| 3 | Slight blotting and enlarging of dots are found. Printed images are practically usable. |
| 2 | Certain blotting and enlarging of dots are found. Printed images have a low clarity. |
| 1 | Significant blotting and enlarging of dots are found. Printed images are unclear. |

[Measurement of CD Stiffness of Paper Sheet]

The stiffness of the coated paper sheet in closs (tranverse) direction of the sheet was measured by using a Clark stiffness tester in accordance with TAPPI T451.

The test results are shown in Tables 3 to 5.

TABLE 1

Properties of binder copolymers

| | Type of binder copolymer (Trademark) | Copolymer molecular structure | Glass transition Temperature (° C.) Core segment (Tg1) | Shell segment (Tg2) | Difference Tg2 − Tg1 | Average particle size (μm) | Content of toluene-insoluble fraction (%) |
|---|---|---|---|---|---|---|---|
| A | S 2524 | Core-shell composite | −10 | +28 | 38 | 110 | 65 |
| B | P-8892 | Core-shell composite | −5 | +60 | 65 | 130 | 85 |
| C | T-2702F | Core-shell composite | −45 | +10 | 55 | 120 | 89 |
| D | T-2699B | Core-shell composite | −35 | +0 | 40 | 130 | 88 |
| E | POT 7092 | Single phase | +35 | | 0 | 85 | 65 |
| F | NIPOL 2507 | Single phase | +54 | | 0 | — | — |
| C | OX 1103 | Single phase | +24 | | 0 | 85 | 78 |
| H | G 1176 | Homogeneous single phase | −52 | | 0 | 130 | 84 |
| I | T-2255 | Homogeneous single phase | +30 | | 0 | 190 | 70 |
| J | T2250K | Homogeneous single phase | −14 | | 0 | 140 | 65 |

TABLE 2

| | Pigment | | | Aspect ratio | Average particle size | Distribution % of 0.3 to 1.5 μm size particles |
|---|---|---|---|---|---|---|
| | Type | Trademark | Crystal form | (L/W) | (μm) | (%) |
| a | Structural kaolin | ASTRAPLUS | Hexagonal plate | 10 | 0.7 | 70 |
| b | Kaolin | KAOGLOSS | Hexagonal plate | 16 | 0.4 | 50 |
| c | Delaminated kaolin | ASTRAPLATE | Hexagonal plate | 40 | 1.0 | 50 |
| d | Precipitated calcium carbonate | BRILLIANT S15 | Cubic | 1 | 0.5 | 50 |

TABLE 3

| | Coating layer | | | | Properties of coated paper sheet | | | | | |
|---|---|---|---|---|---|---|---|---|---|---|
| | Inorganic pigment | | | | 75° | Air | Dot- | | | Clark |
| Example No. | Type | Content (Part by mass) | Type of copolymer binder | Coating amount ($g/m^2$) | specular glossiness (%) | permea-bility (s) | missing-preventing-property | Dot-reproduc-ibility | Density ($g/m^3$) | stiffness in CD (cm) |
| Example | | | | | | | | | | |
| 1 | b | 70 | A | 12 | 65 | 6000 | 3 | 3 | 1.05 | 18.0 |
| 2 | a | 70 | A | 12 | 65 | 2000 | 4 | 4 | 1.05 | 18.0 |
| 3 | c | 70 | A | 12 | 65 | 4000 | 3 | 3 | 1.05 | 18.0 |
| 4 | a | 70 | B | 12 | 65 | 1000 | 4 | 4 | 1.00 | 19.0 |
| 5 | a | 70 | C | 12 | 65 | 2000 | 4 | 4 | 1.05 | 18.0 |
| 6 | a | 70 | D | 12 | 65 | 3000 | 4 | 4 | 1.05 | 18.0 |
| 7 | a | 95 | A | 12 | 65 | 1000 | 4 | 4 | 1.05 | 18.0 |
| 8 | a | 55 | A | 12 | 65 | 4000 | 3 | 3 | 1.05 | 18.0 |
| 9 | a | 70 | A | 8 | 65 | 4000 | 3 | 3 | 1.03 | 18.0 |
| 10 | a | 70 | A | 16 | 65 | 3000 | 4 | 4 | 1.05 | 17.8 |
| 11 | a | 70 | B | 12 | 80 | 3000 | 4 | 4 | 1.05 | 18.5 |

Note:
A . . . S2524 ®, B . . . P8892 ®, C . . . T2702F ®, D . . . T2699B ®, a . . . ASTRAPLUS ®, b . . . KAOGLOSS ®, C . . . ASTRAPLATE ®

TABLE 4

| | Coating layer | | | | Properties of coated paper sheet | | | | | |
|---|---|---|---|---|---|---|---|---|---|---|
| | Inorganic pigment | | | | 75° | Air | Dot- | | | Clark |
| Example No. | Type | Content (Part by mass) | Type of copolymer binder | Coating amount ($g/m^2$) | specular glossiness (%) | permea-bility (s) | missing-preventing-property | Dot-reproduc-ibility | Density ($g/m^3$) | stiffness in CD (cm) |
| Example | | | | | | | | | | |
| 12 | a | 35 | A | 12 | 65 | 3000 | 3 | 3 | 1.05 | 15.0 |
| | b | 65 | | | | | | | | |
| 13 | a | 35 | E | 12 | 65 | 3000 | 3 | 3 | 1.05 | 17.0 |
| | b | 65 | A | | | | | | | |
| 14 | a | 35 | E | 12 | 80 | 3000 | 4 | 4 | 1.03 | 17.5 |
| | b | 65 | A | | | | | | | |
| 15 | a | 35 | E | 12 | 65 | 3000 | 3 | 3 | 1.05 | 17.5 |
| | b | 65 | | | | | | | | |
| 16 | a | 35 | E | 12 | 80 | 3000 | 4 | 4 | 1.03 | 17.8 |
| | b | 65 | | | | | | | | |
| 17 | a | 35 | F | 12 | 80 | 3000 | 4 | 4 | 1.03 | 18.0 |
| | b | 65 | | | | | | | | |
| 18 | a | 35 | G | 12 | 80 | 3000 | 4 | 4 | 1.03 | 17.3 |
| | b | 65 | | | | | | | | |

Note:
E . . . POT 7092 ®, F . . . NIPOL 2707 ®, G . . . OX 1103 ®

TABLE 5

| | Coating layer | | | | Properties of coated paper sheet | | | | | |
|---|---|---|---|---|---|---|---|---|---|---|
| | Inorganic pigment | | | | | | | | | |
| Example No. | Type | Content (Part by mass) | Type of copolymer binder | Coating amount ($g/m^2$) | 75° specular glossiness (%) | Air permeability (s) | Dot-missing-preventing-property | Dot-reproducibility | Density ($g/m^3$) | Clark stiffness in CD (cm) |
| Comparative Example | | | | | | | | | | |
| 1 | b | 70 | H | 12 | 65 | 8000 | 1 | 1 | 1.05 | 18.0 |
| 2 | b | 70 | J | 12 | 65 | 8000 | 1 | 1 | 1.05 | 18.0 |
| 3 | b | 90 | A | 12 | 65 | 12000 | 4 | 1 | 1.05 | 18.0 |
| 4 | b | 20 | A | 12 | 45 | 4000 | 3 | 3 | 1.15 | 17.0 |
| 5 | d | 100 | A | 12 | 45 | 8000 | 1 | 1 | 1.20 | 17.0 |

Note:
H . . . G1176 ®, J . . . T2250K ®, d . . . BRILLIANT S15 ®

The coated paper sheets of the present invention have a high white paper gloss and a high dot-missing-preventing property and a high dot-reproducibility particularly in gravure printing and can be printed with ink images having a high clarity. Accordingly, the coated paper sheet of the present invention has an excellent applicability in practice.

What is claimed is:

1. A coated paper sheet comprising a substrate paper sheet and a coating layer, formed on at least one surface of the substrate paper sheet and comprising a pigment and a binder, wherein, the substrate paper sheet is one sizepressed with a sizing agent comprising an oxidized starch;

the pigment in the coating layer comprises kaolin particles having an average particle size of 0.3 to 1.5 $\mu$m and satisfying the requirement represented by the equation (1):

$$5 \leqq L/W \leqq 16 \quad (1)$$

wherein L represents a major axis of the kaolin particles and W represents a minor axis of the kaolin particles;

the binder in the coating layer comprises both (a) a copolymer having a glass transition temperature of 10 to 60° C. and a single phase structure and (b) a synthetic polymeric compound having a core-shell composite structure and satisfying the requirements represented by the inequalities (2) and (3);

$$Tg\mathbf{1} < Tg\mathbf{2} \quad (2)$$

and $$-10° \text{ C. } Tg\mathbf{2} < 100° \text{ C.} \quad (3)$$

wherein Tg1 represents a glass transition temperature of a core segment of the synthetic polymeric compound, and Tg2 represents a glass transition temperature of a shell segment of the synthetic polymeric compound;

the surface of the coating layer exhibits a 75 degree specular glossiness of 50% or more, determined in accordance with Japanese Industrial Standard Z8741-1997; and the coated paper sheet exhibits an air permeability of 7000 seconds or less, determined in accordance with Japanese Industrial Standard P8117-1998 and a clark stiffness of 12 cm or more in the transverse direction of the coated paper sheet.

2. The coated paper sheet as claimed in claim 1, wherein the kaolin particles are present in an amount of 30 parts or more by mass per 100 parts by mass of the total amount of the pigment contained in the coating layer.

3. The coated paper sheet as claimed in claim 1, wherein the synthetic polymeric compound (b) having the core-shell composite structure and contained, as a binder, in the coating layer is present in an amount of 2 to 25 parts by mass per 100 parts by mass of the total amount of the pigment.

4. The coated paper sheet as claimed in any one of claims 1, 2, or 3, being one surface-smoothed by a calendering treatment at a calendering roll surface temperature of 80° C. or more.

* * * * *